US008542152B2

(12) United States Patent
Yu et al.

(10) Patent No.: US 8,542,152 B2
(45) Date of Patent: Sep. 24, 2013

(54) MULTI-BAND ANTENNA

(75) Inventors: Chih-Yin Yu, Yilan County (TW); Shih-Chi Lai, Miaoli County (TW); Chia-Lun Tang, Miaoli County (TW); Jia-Yi Sze, Taoyuan County (TW)

(73) Assignee: Auden Techno Corp., Taoyuan County (TW)

( * ) Notice: Subject to any disclaimer, the term of this patent is extended or adjusted under 35 U.S.C. 154(b) by 354 days.

(21) Appl. No.: 13/004,253

(22) Filed: Jan. 11, 2011

(65) Prior Publication Data

US 2012/0176273 A1 Jul. 12, 2012

(51) Int. Cl.
*H01Q 1/38* (2006.01)
*H01Q 1/24* (2006.01)

(52) U.S. Cl.
USPC ..... 343/700 MS; 343/702; 343/846

(58) Field of Classification Search
None
See application file for complete search history.

(56) References Cited

U.S. PATENT DOCUMENTS

| | | | | |
|---|---|---|---|---|
| 8,378,897 | B2 * | 2/2013 | Lai et al. | 343/700 MS |
| 2003/0174092 | A1 * | 9/2003 | Sullivan et al. | 343/702 |
| 2008/0122702 | A1 * | 5/2008 | Lin et al. | 343/700 MS |
| 2008/0180333 | A1 * | 7/2008 | Martiskainen et al. | 343/722 |
| 2011/0109515 | A1 * | 5/2011 | Rao | 343/702 |
| 2012/0154222 | A1 * | 6/2012 | Oh et al. | 343/702 |

* cited by examiner

*Primary Examiner* — Trinh Dinh
(74) *Attorney, Agent, or Firm* — Rosenberg, Klein & Lee

(57) ABSTRACT

A multi-frequency antenna includes a microwave substrate, a first antenna unit, a second antenna unit, a third antenna unit and a grounding unit. The first antenna unit, the second antenna unit, and the third antenna unit are disposed on the microwave substrate surface. The grounding unit is disposed at an edge on the surface of the microwave substrate. The grounding unit is in connection with the second antenna unit. The second antenna unit and the third antenna unit are bent to form perpendicular structures to the microwave substrate. The compact arrangement reduces the physical footprint of the antenna module to enable fitment in a wide range of products having tight special constraint.

6 Claims, 6 Drawing Sheets

MULTI-BAND ANTENNA

BACKGROUND OF THE INVENTION

1. Field of the Invention

The instant disclosure relates to a multi-band antenna, and more particularly, to a multi-band antenna for wireless communication signal receiving and transmitting.

2. Description of Related Art

Antenna is an important component of modern wireless-communication devices. The main function of an antenna is to provide signal reception and transmission. Antennas of different shapes and sizes can be found in the entire range of 3C products, including laptop computers, mobile phones, GPS (global positioning system) navigators, digital TVs and many other applications. Different communication standards often require antennas having different operating frequency bands. Moreover, as modern wireless-communication devices grow lighter and smaller, the research for wide-band miniaturized antennas receive much attention.

Multi-band antenna designs encounter a technical challenge of antenna size miniaturization because the negative effects of coupling interference between nearby antenna components may become more influential as the antenna's physical dimensions are reduced. The coupling interference between each component on a miniature multi-band antenna in close proximity may cause serious of impedance bandwidth, antenna gain and efficiency.

Conventional multi-band antennas often include a substrate, a plurality of antenna radiation portions, a grounding portion, and a feeding portion. The multi-band operations can be achieved by incorporating several compositions that support different resonant frequency bands on a single antenna unit.

However, the conventional multi-band antenna cannot fully support the Wi-Fi (2.4 GHz), Bluetooth (2.4-2.5 GHz), WiMAX (2.5 GHz), GSM900/1800 and GPS (1.57 GHz) operations. Consequently, it is difficult to concurrently integrate the operating bandwidths for wireless networks, mobile phones, and global positioning systems into a wireless-communication device having only a single antenna unit.

Based on research and related industrial experience, the inventor proposes the following solution for addressing the above issues.

SUMMARY OF THE INVENTION

The object of the instant disclosure is to provide a multi-band antenna, which has multiple operating bandwidths and covers bandwidths from low-frequency to high-frequency Particularly, the instant disclosure provides a multi-band antenna, which includes a microwave substrate, a first antenna unit, a second antenna unit, a third antenna unit and a grounding unit. The first antenna unit, the second antenna unit and the third antenna unit are printed on the surface of the microwave substrate. The grounding unit, connecting to the second antenna unit can be made by metallic foil arranged at an edge of the microwave substrate. The constructions of the second antenna unit and the third antenna unit can be divided into two parts that are perpendicular to each other, which can reduce the size of the proposed antenna.

The multi-band antenna can cover the frequencies of 670~800 MHz, 800~960 MHz and 1570~3000 MHz. Also, by adjusting the spacing between the three antenna units, the electromagnetic coupling may be altered for fine tuning the resonant frequency of the antenna to meet the requirement of various wireless standards with different operating frequencies.

In order to further realize the characteristics and technical contents of the instant disclosure, figures of measured results and detailed descriptions of the instant disclosure are presented in the following. However, the abovementioned figures and descriptions are merely shown for exemplary purposes, rather than being used to restrict the scope of the instant disclosure.

DETAILED DESCRIPTION OF THE PREFERRED EMBODIMENTS

Figure 1:
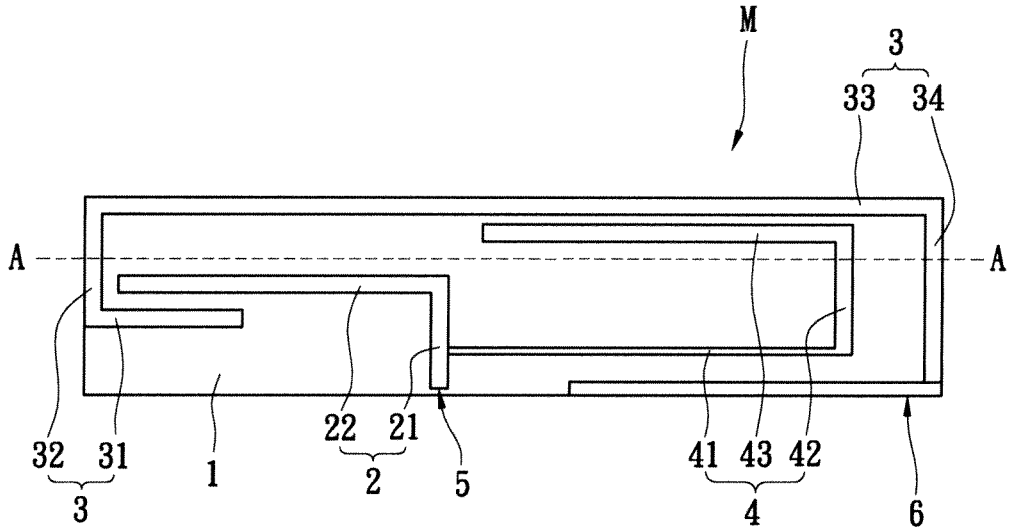
FIG. 1 shows a plane diagram of the first embodiment of the instant disclosure.
Figure 2:
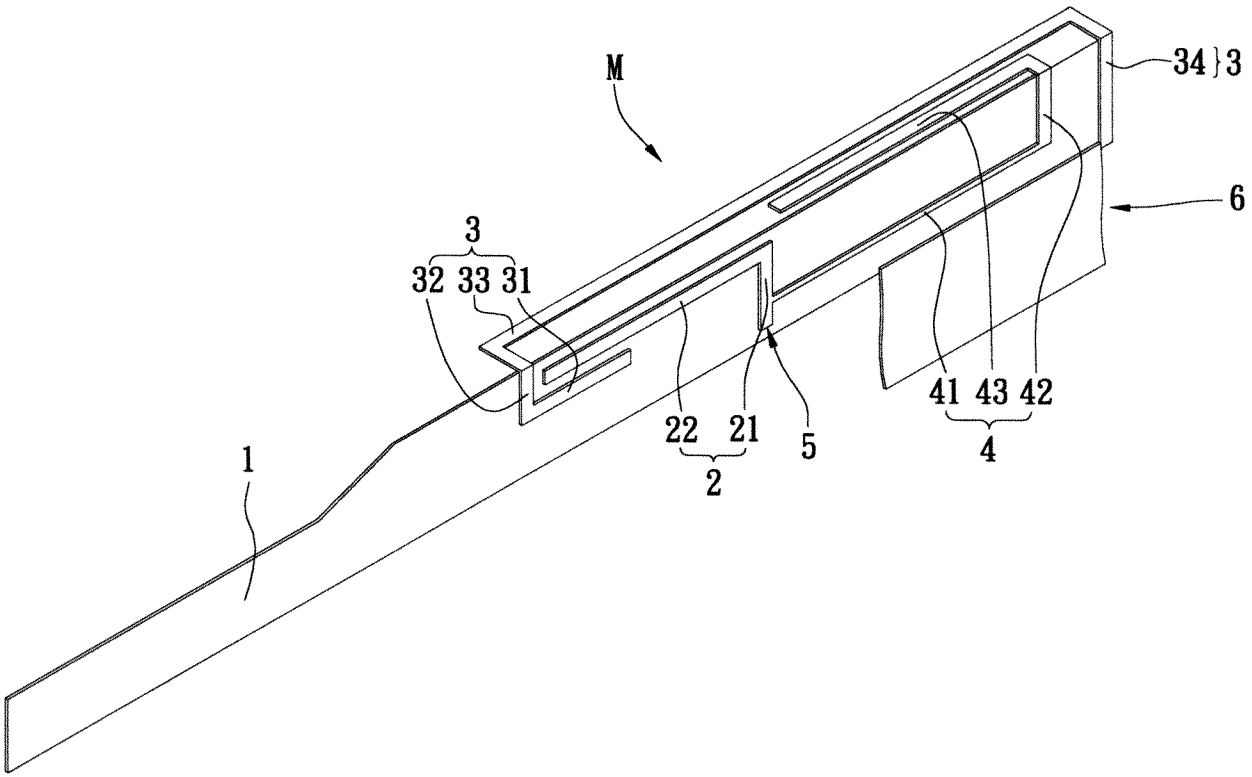
FIG. 2 shows a stereogram of the first embodiment of the instant disclosure.

Please refer to FIG. 1 and FIG. 2, which show the configurations of the first embodiment of the instant disclosure for a multi-band antenna M. The multi-band antenna M includes a microwave substrate 1, a first antenna unit 2, a second antenna unit 3, a third antenna unit 4 and a grounding unit 6.

The first antenna unit 2 includes a first extended segment 21 and a first distal segment 22. The first distal segment 22 is connected to the terminal portion of the first extended segment 21. The first distal segment 22 is perpendicular to the first extended segment 21. The feeding point 5 of the first antenna unit 2 can be connected to a 50 Ω coaxial cable.

The second antenna unit 3 includes a second extended segment 31, a second bent segment 32, a second straight segment 33, and a second distal segment 34. The second bent segment 32 is connected to the terminal portion of the second extended segment 31. The second bent segment 32 is perpendicular to the second extended segment 31, and the second extended segment 31 is parallel to the first distal segment 22. The gap between the second extended segment 31 and the first distal segment 22 can be 1 mm. The second straight segment 33 is connected to the terminal portion of the second bent segment 32. The second straight segment 33 is perpendicular to the second bent segment 32, and the straight segment 33 is parallel to the first distal segment 22. The second distal segment 34 is connected to the terminal portion of the second straight segment 33. The second distal segment 34 is perpendicular to the second straight segment 33, and the second distal segment 34 is parallel to the first extended segment 21.

The third antenna unit 4 includes a third extended segment 41, a third bent segment 42, and a third distal segment 43. The third bent segment 42 is connected to the terminal portion of the third extended segment 41. The third bent segment 42 is perpendicular to the third extended segment 41, and the third bent segment 42 is parallel to the first extended segment 21. The third distal segment 43 is connected to the terminal portion of the third bent segment 42. The third distal segment 43 is perpendicular to the third bent segment 42, and the third distal segment 43 is parallel to the second straight segment 33. The third extended segment 41 is perpendicular to the first extended segment 21.

As shown in FIG. 1, the constructions of the second antenna unit 3 and the third antenna unit 4 can be bent along the dash line A-A on the microwave substrate 1 and divided into two parts. One part is perpendicular to the other (show in FIG. 2). This arrangement may help reducing the physical dimensions of the proposed antenna on the microwave substrate. Thus, the instant disclosure of the multi-band antenna can be placed in a 55*8*4 $mm^3$ volume of space, which can obtain the optimal use of space.

Figure 3:
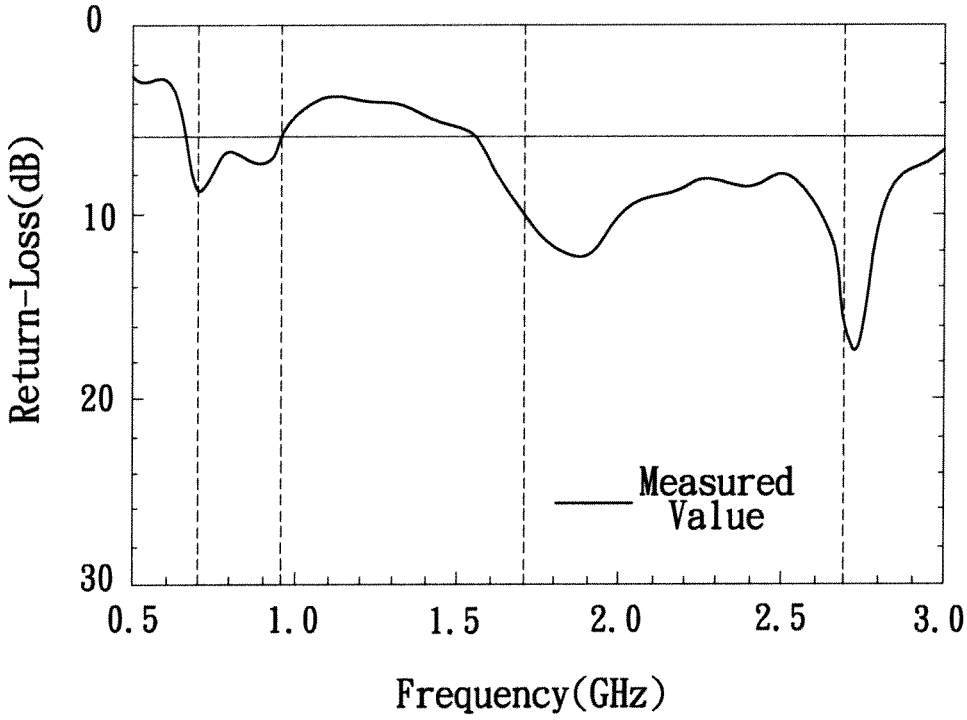
FIG. 3 shows the measured return loss of the first embodiment of the instant disclosure.

Please refer to FIG. 3, which shows the measured return-loss curve for the first embodiment of the multi-band antenna M. This curve shows that multi-band antenna M can obtain four resonant modes exciting at lower and higher frequencies ranged from 670 to 960 MHz and from 1570 to 3000 MHz, respectively, within the definition of 6-dB return loss. The first antenna unit 2 can stimulate the resonant mode excited at frequencies from 1570 to 3000 MHz. The first antenna unit 2 and the second antenna unit 3 can couple each other to generate two resonant modes excited at frequencies from 670 to 800 MHz and 1570 to 3000 MHz, respectively. The second antenna unit 3 and the third antenna unit 4 can couple each other to generate a resonance ranged from 800 to 960 MHz. Furthermore, the impedance matching of the lower frequency band and the higher band can be improved by adjusting the strip width of the third extended segment 41 and the structure parameters of the third antenna unit 4, respectively.

Figure 4:
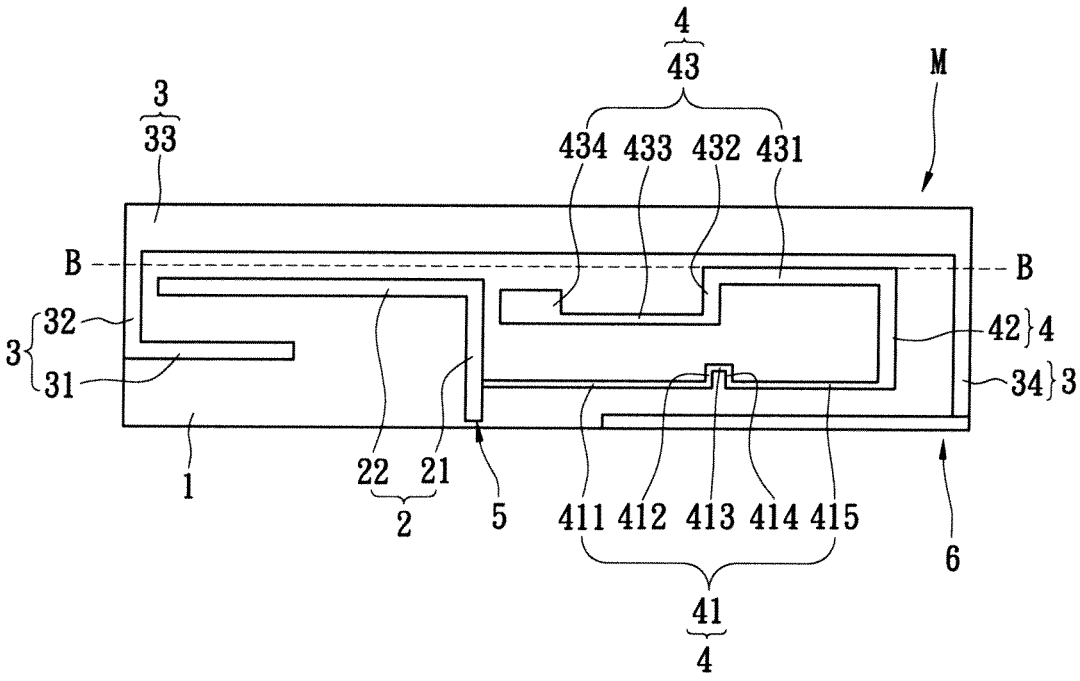
FIG. 4 shows a plane diagram of the second embodiment of the instant disclosure.
Figure 5:
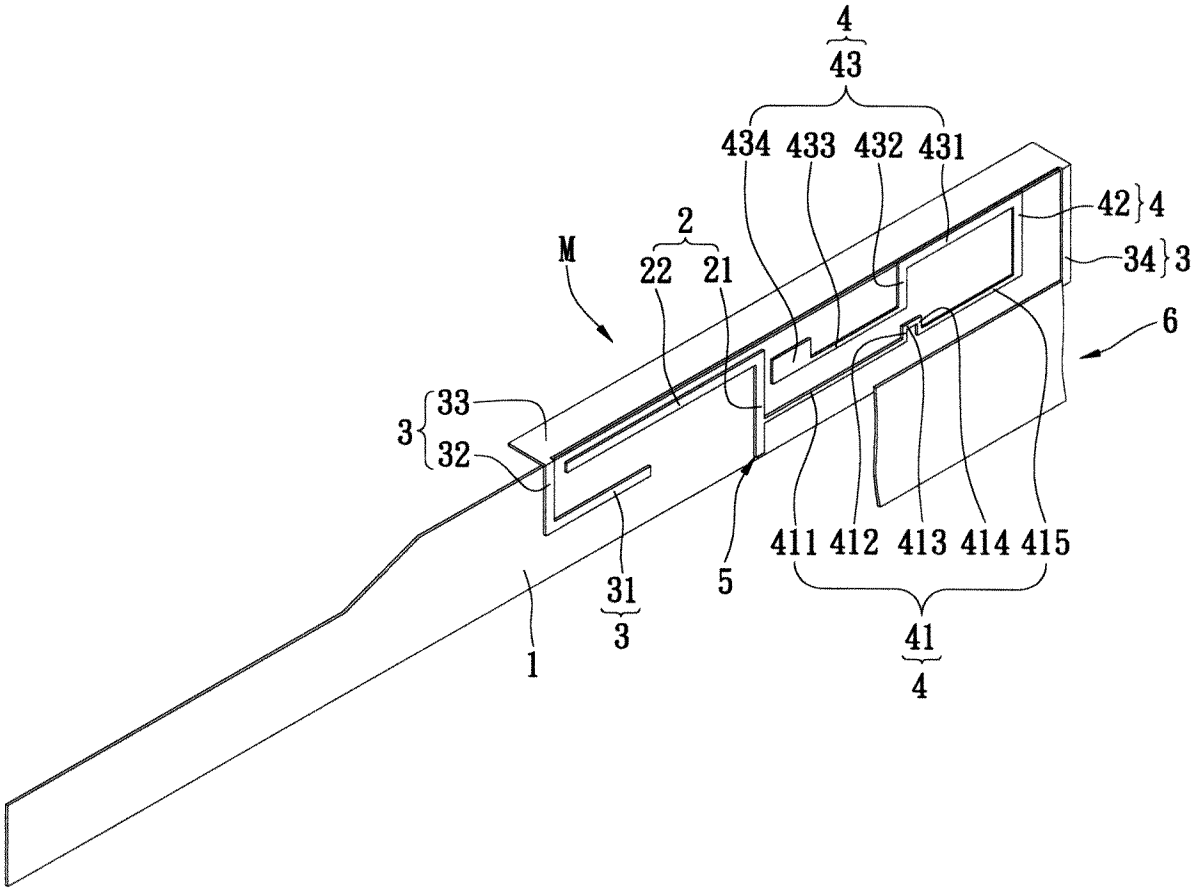
FIG. 5 shows a stereogram of the second embodiment of the instant disclosure.

Please refer to FIG. 4 and FIG. 5, which show a multi-band antenna M in accordance with the second embodiment of the instant disclosure. The multi-band antenna M includes a microwave substrate 1, a first antenna unit 2, a second antenna unit 3, a third antenna unit 4, and a grounding unit 6. The first antenna unit 2 and the second antenna unit 3 in the second embodiment share similar structural arrangements with the first embodiment. However, in the second embodiment, portions of the second and the third antenna units may be constructed without a bent portion. The flexibility of structural layout allows the instant antenna units to be adjusted to suit particular operational or spatial requirements.

The third antenna unit 4 is disposed on the surface of the microwave substrate 1, and includes a third extended segment 41, a third bent segment 42, and a third distal segment 43. The third extended segment 41 comprises a first section 411, a second section 412, a third section 413, a fourth section 414, and a fifth section 415. The second section 412 is connected to the terminal portion of the first section 411. The second section 412 is perpendicular to the first section 411, and the second section 412 is arranged substantially parallel to the first extended segment 21. The third section 413 is connected to the terminal portion of the second section 412. The third section 413 is substantially perpendicular to the second section 412, and the third section 413 is substantially parallel to the second straight segment 33. The fourth section 414 is connected to the terminal portion of the third section 413. The fourth section 414 is substantially perpendicular to the third section 413, and the fourth section 414 is substantially parallel to the first extended segment 21. The fifth section 415 is connected to the terminal portion of the fourth section 414. The fifth section 415 is substantially perpendicular to the fourth section 414, and the fifth section 415 is substantially parallel to the second straight segment 33. The third bent segment 42 is connected to the terminal portion of the fifth section 415. The third bent segment 42 is substantially perpendicular to the fifth section 415, and the third bent segment 42 is substantially parallel to the first extended segment 21. The third distal segment 43 includes a sixth section 431, a seventh section 432, a eighth section 433, and a ninth section 434. The sixth section 431 is connected to the terminal portion of the third bent segment 42. The sixth section 431 is arranged substantially perpendicular to the third bent segment 42, and the sixth section 431 is substantially parallel to the second straight segment 33. The seventh section 432 is connected to the terminal portion of the sixth section 431. The seventh section 432 is perpendicular to the sixth section 431, and the seventh section 432 is substantially parallel to the first extended segment 21. The eighth section 433 is connected to the terminal portion of the seventh section 432. The eighth section 433 is perpendicular to the seventh section 432, and the eighth section 433 will be parallel to the second straight segment 33. The ninth section 434 is connected to the terminal portion of the eighth section 433. The ninth section 434 is substantially perpendicular to the eighth section 433.

The first antenna unit 2 can be a L-shaped metallic micro-strip. The second antenna unit 3 can be the metallic micro-strip. The third antenna unit 4 can be an U-shaped metallic micro-strip. The grounding unit 6 can be the metallic foil, which is set on the surface of the microwave substrate 1. The one edge of the grounding unit connected with the second antenna unit.

In the instant embodiment, portions of the second antenna unit 3 may be folded to reduce physical dimension alone a specific direction, thus increasing the adaptability of the antenna unit. For example, the broken line B-B across the second antenna unit 3 as shown in FIG. 4 may be folded to form a substantially perpendicular structure with respect to the microwave substrate 1, as show in FIG. 5. The folded structure of the instant antenna makes it particularly suitable for fitting around tight corners inside a miniature electronic device.

The difference between the first embodiment and the second embodiment is the width of metallic micro-strips. We can adjust the width of metallic micro-strips for differential impedance matching of the operating bandwidth. Thus, it can increase the efficient use of antenna and achieve greater efficiency.

In the second embodiment, the width of metallic micro-strip of the second straight segment 33 can be 3 mm. The width of metallic micro-strip of the first section 411, the second section 412, the third section 413, the fourth Section 414, and the fifth section 415 can be 0.3 mm. The width of metallic micro-strip of the third bent segment 42, the sixth section 431, and the seventh section 432 can be 1 mm. The width of metallic micro-strip of the eighth section 433 can be 0.5 mm. The square measure of metallic piece of the ninth section 434 can be 4*2 $mm^2$.

Figure 6:
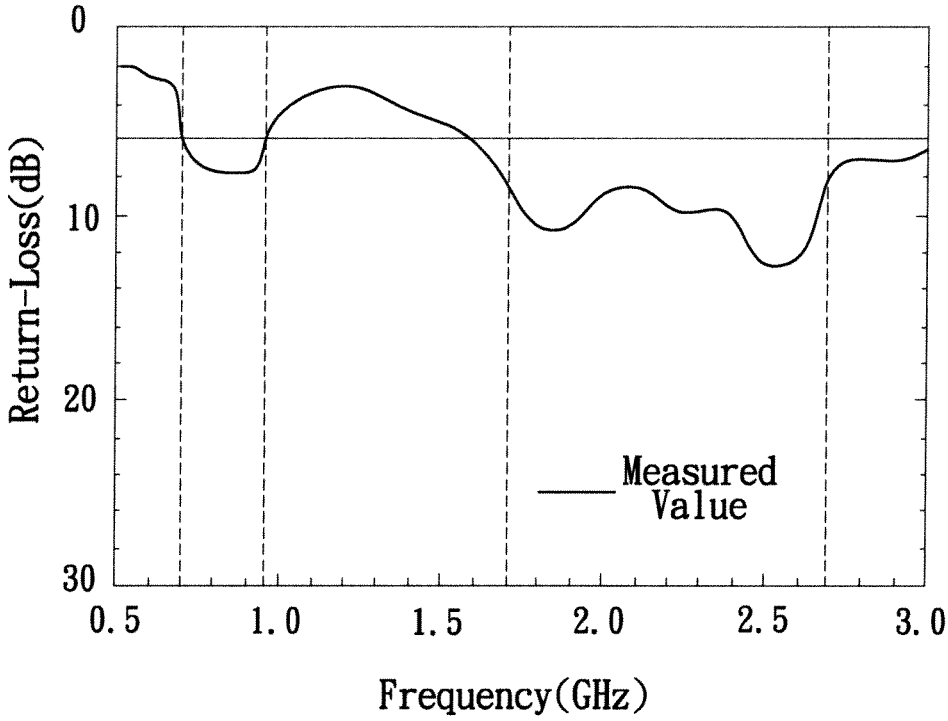
FIG. 6 shows the measured return loss of the second embodiment according to the instant disclosure.

Finally, please refer to FIG. 6, which shows the measured return-loss curve according to the second embodiment. The favorable results shown in FIG. 6 are similar to that of FIG. 3. Specifically, not only we can adjust the metallic micro-strip of the third extended segment 41 of the third antenna unit 4 to enhance the impedance matching of the low-frequency bandwidth, but also can adjust the structure of the third antenna unit 4 to enhance the impedance matching of the high-frequency.

Based on the above discussions, the instant disclosure has the following advantages. Mainly, the multi-band antenna reach the resonance mode for 670~800 MHz, 800~960 MHz and 1570~3000 MHz. We can adjust the spacing between antenna units to control the electromagnetic coupling. Then, tune the resonant frequency up to reach the various wireless standards of the operating bandwidth. Otherwise, parts of the second and the third antenna units are perpendicular to the microwave substrate, which can reduce the planer area of the microwave substrate.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A multi-band antenna comprising:

a substrate;

a first antenna unit disposed on a surface of the substrate having a feeding point, wherein the first antenna unit includes a first extended segment, and a first distal segment, wherein the first distal segment is connected to the first extended segment;

a second antenna unit disposed on the surface of the substrate, wherein the second antenna unit includes a second extended segment, a second bent segment, a second straight segment, and a second distal segment;

a third antenna unit disposed on the surface of the substrate in connection with the first antenna unit, wherein the third antenna unit includes a third extended segment, a third bent segment, and a third distal segment, and wherein the third extended segment of the third antenna unit includes a first section, a second section, a third section, a fourth section, and a fifth section subsequently interconnected, wherein the third distal segment includes a sixth section, a seventh section, an eighth section, and a ninth section subsequently interconnected; and a grounding unit disposed on the substrate, wherein one edge of the grounding unit connects to the second antenna unit.

2. The multi-band antenna of claim 1 wherein a gap between the second extended segment and the first distal segment is 1 mm.

3. The multi-band antenna of claim 1 wherein the first distal segment is perpendicular to the first extended segment and the third extended segment is perpendicular to the first extended segment.

4. The multi-band antenna of claim 1 wherein the second antenna unit and the third antenna unit are respectively bent along an edge of the substrate to form perpendicular structures with respect to the substrate.

5. The multi-band antenna of claim 1 wherein the first antenna unit is a L-shaped metallic micro-strip, the second antenna unit is a metallic micro-strip, and the third antenna unit is a U-shaped metallic micro-strip.

6. The multi-band antenna of claim 1 wherein the grounding unit is a metallic foil disposed on the surface of the substrate, and the one edge of the grounding unit connected with the second antenna unit.

* * * * *